US005165598A

United States Patent [19]

Ortwein

[11] Patent Number: 5,165,598

[45] Date of Patent: Nov. 24, 1992

[54] RESILIENTLY MOUNTED RAIL FOR RAIL VEHICLES

[75] Inventor: Elisabeth Ortwein, Köln, Fed. Rep. of Germany

[73] Assignee: Hermann Ortwein, Cologne, Fed. Rep. of Germany

[21] Appl. No.: 602,311

[22] PCT Filed: May 30, 1989

[86] PCT No.: PCT/EP89/00607

§ 371 Date: Nov. 16, 1990

§ 102(e) Date: Nov. 16, 1990

[87] PCT Pub. No.: WO87/12140

PCT Pub. Date: Dec. 14, 1989

[30] Foreign Application Priority Data

Jun. 1, 1988 [DE] Fed. Rep. of Germany ... 8807195[U]

[51] Int. Cl.[5] ..... E01B 9/62

[52] U.S. Cl. ..... 238/283; 238/382; 238/336

[58] Field of Search ..... 238/130, 149, 264, 267, 238/275, 276, 283, 292, 293, 306, 307, 122, 336, 129, 382, 2, 8

[56] References Cited

U.S. PATENT DOCUMENTS

| | | | |
|---|---|---|---|
| 223,052 | 12/1879 | Mack | 238/283 |
| 2,670,136 | 2/1954 | Moses | 238/382 X |
| 3,295,760 | 1/1967 | Moses | 238/283 |
| 3,358,927 | 12/1967 | Hein et al. | 238/283 X |
| 3,387,781 | 6/1968 | Moses et al. | 238/283 X |
| 3,417,922 | 12/1968 | Dargier | 238/283 X |
| 3,525,472 | 8/1970 | Sato | 238/382 X |
| 3,826,423 | 7/1974 | McClung | 238/283 X |
| 3,945,566 | 3/1976 | Bush | 238/283 X |
| 4,527,736 | 7/1985 | Ortwein | 238/283 |
| 4,775,103 | 10/1988 | Ortwein | 238/283 |

FOREIGN PATENT DOCUMENTS

| | | | |
|---|---|---|---|
| 1194010 | 9/1985 | Canada | 238/283 |
| 7701846 | 6/1977 | Netherlands | 238/283 |
| 8502313 | 3/1987 | Netherlands | 238/283 |

*Primary Examiner*—Michael S. Huppert
*Assistant Examiner*—James Eller
*Attorney, Agent, or Firm*—Herbert Dubno

[57] ABSTRACT

A rail assembly in which the shanks of a rail between the head and the base have one pair of outwardly facing downwardly tapering flank surfaces and a frame flanking the rail has a pair of downwardly tapering inwardly facing flank surfaces spaced from and juxtaposed with the surfaces of the rail. The surfaces receive between them under precompression so as to generate a spring constant of 2 KN/mm to 8 KN/mm per meter of rail length, elastic intermediate layers which resiliently support the rail. One of the pairs of surfaces is composed of angularly adjoining upper and lower portions while the other is rectilinear over the height thereof juxtaposed with the first mentioned pair.

11 Claims, 5 Drawing Sheets

RESILIENTLY MOUNTED RAIL FOR RAIL VEHICLES

FIELD OF THE INVENTION

Cross-Reference to Related Application

This application is a National Phase of Patent EP 89,/00,607 filed May 30, 1989 and based, in turn, upon German National application G 88 07 195.2 filed Jun. 1, 1988 under the International Convention.

The invention relates to a resiliently mounted rail for rail vehicles, wherein the laterally limiting surfaces located below the rail head abut against the inner lateral surfaces of a frame, flanking the rail whereby in the area of abutment the lateral limiting surfaces of the rail and/or the inner lateral surfaces of the frame are subdivided into two segments—a lower and an upper segment—each of them tapering downwardly.

BACKGROUND OF THE INVENTION

In known rails of the aforementioned kind, the shape of the characteristic curve resulting from the presence of the elastic intermediate layer when the rail is under load is solely determined by the characteristics of the material of the elastic intermediate layer. This is particularly disadvantageous in a rail with standard rail profile (U.S. Pat. No. 3,525,472), because here the angle formed by the lateral limiting surfaces of the rail below the rail head with the vertical is very large in the upper segment and very small in the lower segment, so that when the characteristic curve for the vertical load of the rail is correctly established, the elastic intermediate layers are too hard for the horizontally occurring load, while when the characteristic curve for the horizontal load of the rail is correctly established, the elastic intermediate layers are too soft for the vertical load. Therefore, in practice there is always a compromise solution, which does not offer an optimal shape of the characteristic curve in any load direction. In a rail of this type, the sound attenuation is extraordinarily low.

An improved sound damping is achieved with another known rail, wherein in the area of the rail web a rectilinearly downward tapering area is provided, over which the rail abuts against a frame via elastic intermediate layers, the inner lateral surfaces of the frame running also rectilinearly (DE-OS 35 40 128). In this rail, the lateral surfaces limiting the rail below the rail head, as well as the inner lateral surfaces limiting the frame form respectively only one angle with the vertical. This allows for a more correct setting of the characteristic curve.

OBJECT OF THE INVENTION

It is the object of the invention to improve a rail of the aforementioned kind, so that it is possible to establish an optimal characteristic curve for each application and in a way which is superior to the aforementioned known rail.

SUMMARY OF THE INVENTION

According to this invention, in the upper segment the lateral limiting surfaces of the rail form with the vertical an angle ranging between 0° and 10°, in the lower segment the lateral limiting surfaces of the rail form with the vertical an angle ranging between 15° and 30° and the inner lateral limiting surfaces of the frame form with the vertical an angle ranging between 5° and 30°.

According to a feature of the invention, the inner lateral limiting surfaces of the frame form an angle with the vertical, which ranges between 15° and 40°, in the lower segment, the inner lateral surfaces of the frame form an angle with the vertical ranging between 0° and 10°, and the lateral limiting surfaces of the rail form with the vertical an angle between 0° and 30°.

This selection of angles in the upper and lower segments of the lateral limiting surfaces makes it possible to establish to a large extent an optimal characteristic curve.

The angles can be so selected that the angle formed in the upper segment by the surfaces defining the rail and the vertical equals approximately 3°, the angle formed in the lower segment by the surfaces defining the rail with the vertical equals approximately 20°, and the angle formed by the inner lateral limiting surfaces of the frame with the vertical equals approximately 15° angle formed in the upper segment by the inner lateral surfaces of the frame and the vertical can equal approximately 20°, the angle formed in the lower segment by the inner lateral surfaces of the frame and the vertical can equal approximately 3°, and the angle formed by the lateral surfaces limiting the rail with the vertical equals approximately 18°.

In a particularly simple embodiment of the invention, which allows for the use of a standard rail, the elastic intermediate layer extends up to the web of a standard rail.

Each elastic intermediate layer between the rail and the frame can be prestressed in such a manner that it imparts a spring constant between 2 KN/mm and 8 KN/mm, preferably 3.5 KN/mm for each 1 m of rail.

Each elastic intermediate layer can be provided with compartments. By correspondingly selecting the shape and the arrangement of these compartments, the spring excursion over the possible elastic stroke of the rail can be of any desired configuration and, in this way, adjusted to all requirements.

In order to insure that no dirt penetrates these compartments thereby impairing their functioning capability, the compartments are arranged inside the elastic intermediate layer.

The sizes of the compartments is selected so that under normal load, the elastic stroke of the rail ranges between 1 mm and 15 mm, preferably 6 mm. This stroke is sufficient to achieve the desired sound damping and at the same time requires only very little space.

A particularly simple way of influencing the characteristic curve so that it changes its direction when the normal load is reached, the clearances have basically the shape of a rectangle, which extends in the direction of the lateral surfaces limiting the rail, so that the width of the rectangle is so selected that it reaches zero under normal rail load.

According to a further feature of the invention, in each elastic intermediate layer there are at least two such compartments.

In a further development of the invention, the elastic intermediate layers are mutually connected by a connecting piece surrounding the rail base with characteristics similar to those of the elastic intermediate layers, whereby a free space is provided between the rail base and the connection piece or between the connection piece and the frame bottom, the height of this free space corresponding to the elastic stroke of the rail reached under normal load. In this way, the correct arrangement of the elastic intermediate layers is insured during the rail mounting, as well as after that. For the sake of simplicity, the connection piece can be made of the same material as the elastic intermediate layers.

In order to round out the break occurring in the characteristic curve when the normal load of the rail is surpassed, the connection piece can be provided with projections which extend over the entire height of the free space underneath the rail base.

In this way, a certain lateral movability becomes possible for the rail base, since the connection piece is provided with recesses on its side facing away from the rail base.

The penetration of water between the rail and the frame can be prevented when the elastic intermediate layer is provided in the upper area on both sides with approximately triangular projections.

In a preferred embodiment of the invention, at the web of a standard rail, on each side a molded part is attached, whose surface facing away from the rail web performs the functions of a lateral surface limiting the rail.

In order to insure that the position of the molded part is unchangeably set, according to a further feature of the invention, the molded part is fastened by two noses formed in the elastic intermediate layer.

In order to precisely fasten the elastic intermediate layer and this way to facilitate the joining of the rail with the frame, the elastic intermediate layer is fastened to the frame by a projection reaching over the upper edge of the frame. In addition, this considerably improves electric insulation between the rail and the frame.

According to a further feature of the invention, in the case of a prestressed elastic intermediate layer, the distance between the upper surface limiting the rail base and the oppositely positioned frame surface running approximately parallel thereto is at least 5 mm.

SPECIFIC DESCRIPTION

Figure 1:
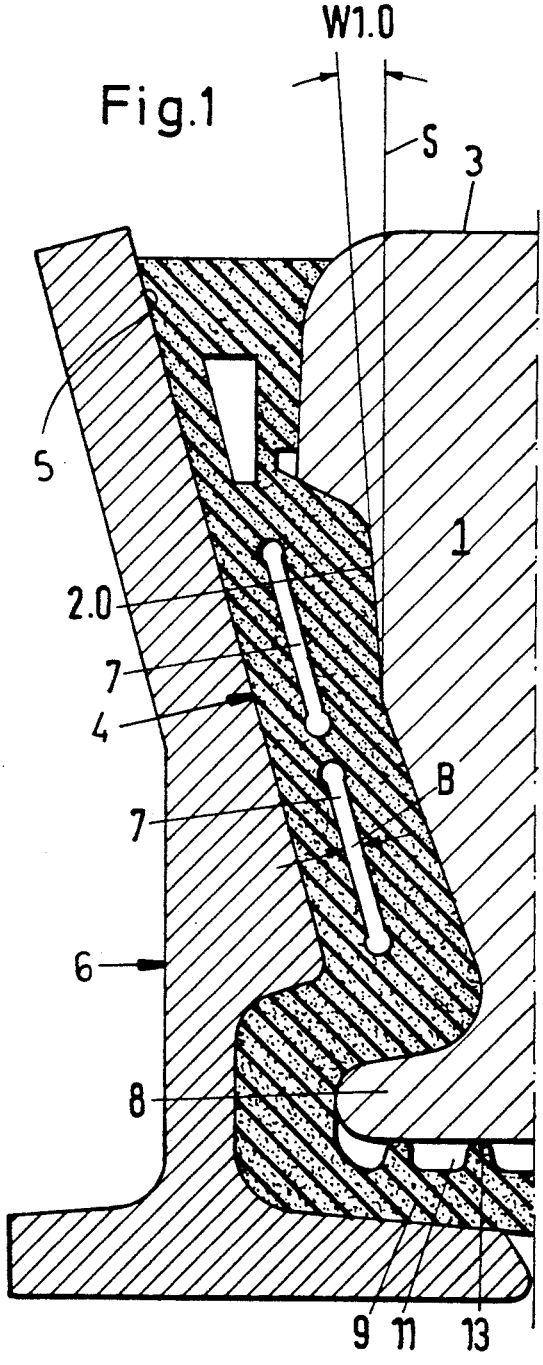
FIG. 1 is a cross sectional view of the left half of a rail enclosed within a frame, wherein the lateral surfaces limiting the rail below the rail head have angularly adjoining portions, while the inner lateral surfaces limiting the frame are rectilinear.
Figure 2:
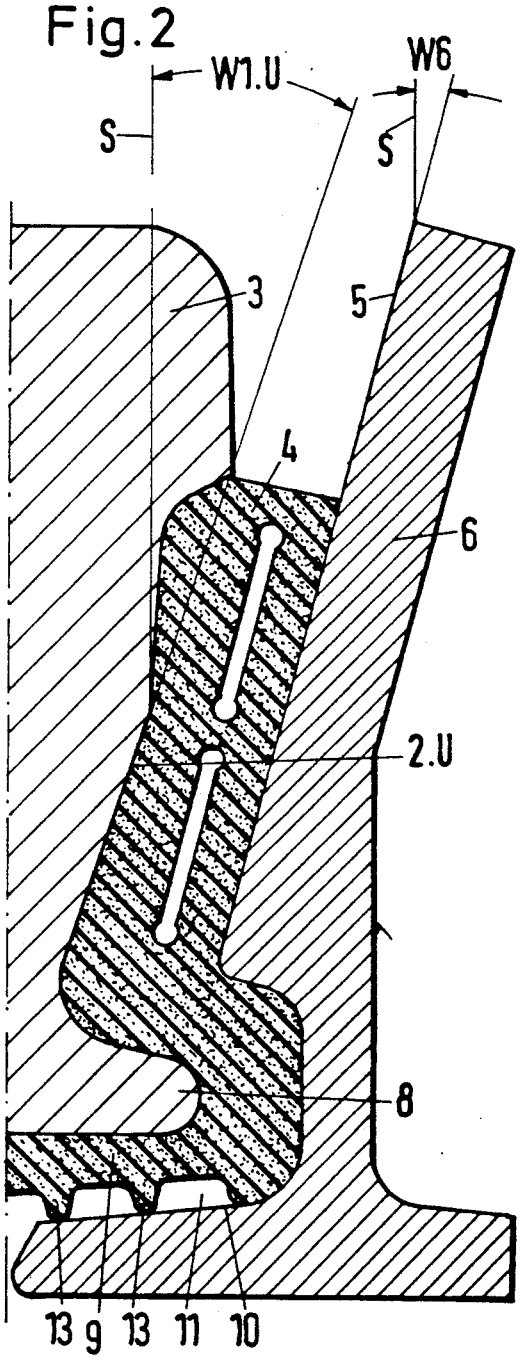
FIG. 2 is a cross sectional view of the right half of the rail represented in FIG. 1, but with another configuration of the connection piece provided underneath the rail base.

In the embodiment shown in FIGS. 1 and 2, the rail 1 rests with its laterally limiting surfaces 2.0 located below the rail head 3 against the inner lateral surfaces 5 limiting the frame 6, with the elastic intermediate layers 4 arranged therebetween. Inside each elastic intermediate layer 4, chambers 7 are provided, which have approximately the shape of a rectangle. This rectangle extends in the direction of the lateral surfaces 2 bounding the rail web. The width B of the rectangular chamber 7, which diminishes when the rail 1 is under load, is so selected that it becomes zero when the normal load indicated by arrow N (compare FIG. 4) is reached. The elastic intermediate layers 4 on opposite flanks are connected to each other by a connection piece 9 surrounding the rail base 8. Underneath the rail base 8, a free space 11 is provided. This free space 11 can be provided between the rail base 8 and the connection piece 9, as shown in FIG. 1, or it can be provided as in FIG. 2, between the connection piece 9 and the bottom 10 of the frame 6. The connection piece 9 can be provided with projections 13, extending over the entire height of the free space 11.

The inner lateral surfaces 5 limiting the frame 6 are rectilinear and form with the vertical S an angle W6, while the lateral surfaces 2 limiting the rail web are bent so that their upper area 2.0 form with the vertical S an angle W1.O and their lower area 2.U forms with the vertical S an angle W1.U.

Figure 3:
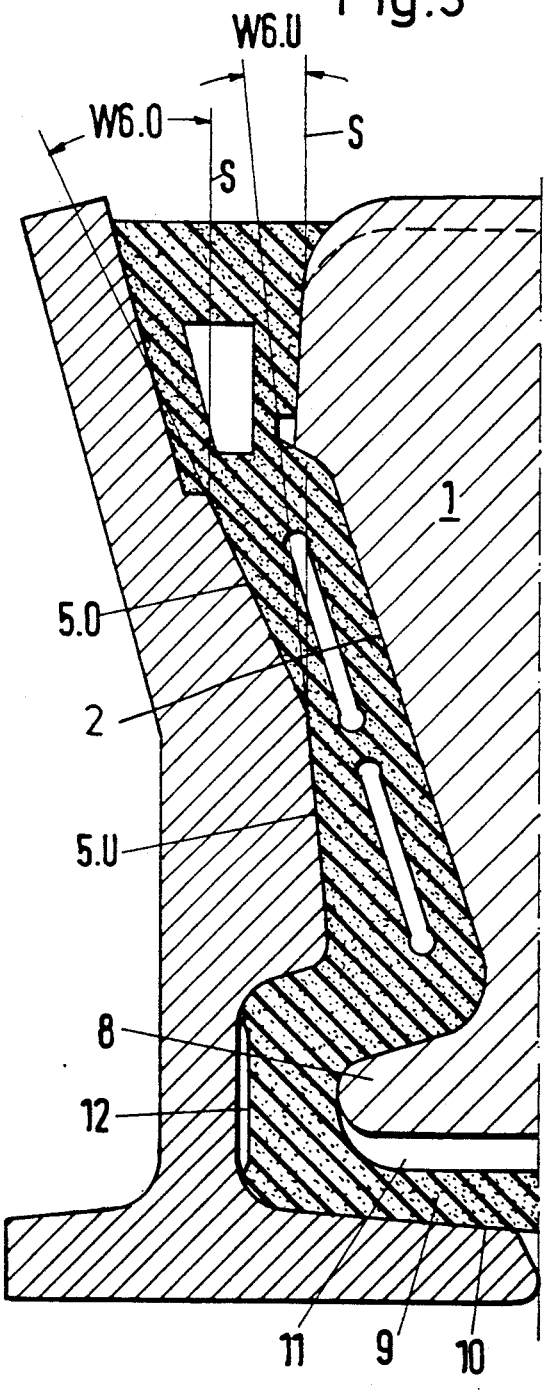
FIG. 3 is a cross sectional view of the left half of a rail surrounded by a frame, wherein the limiting lateral surfaces below the rail head are rectilinear, while the inner lateral surfaces limiting the frame are bent.
Figure 4:
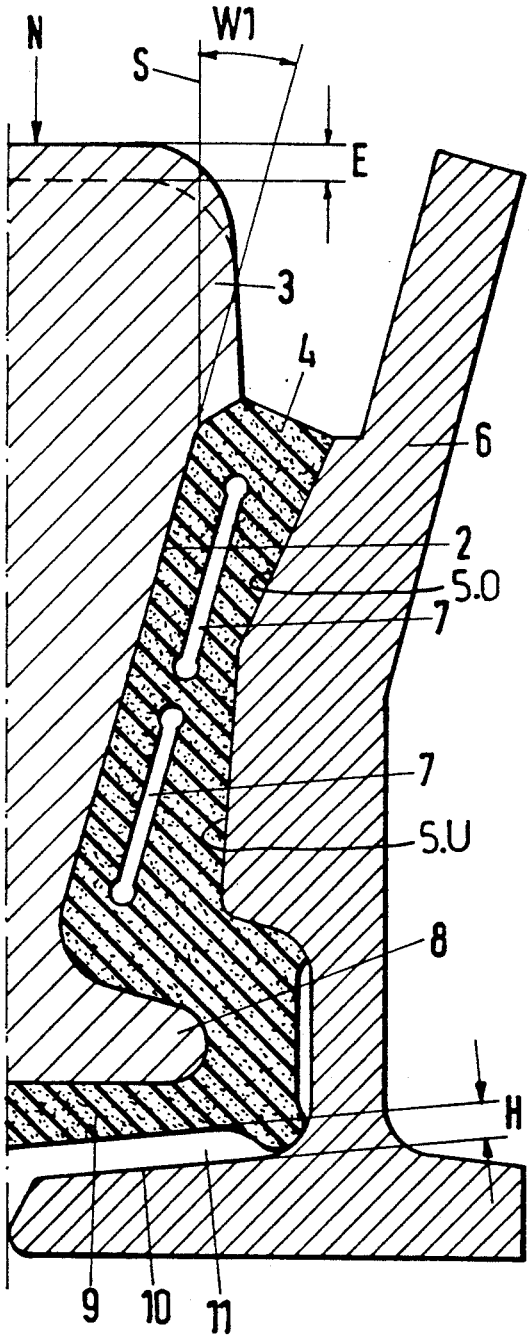
FIG. 4 is a cross sectional view of the right half of the rail represented in FIG. 3, but with another configuration of the connection piece provided underneath the rail frame.

In the embodiment shown in FIGS. 3 and 4, the lateral surfaces 2 limiting the rail web are rectilinear and form thereby with the vertical S only an angle W1, while the inner lateral surfaces 5 limiting the frame 6 are bent so that their upper area 5.0 forms with the vertical S an angle W6.O and their lower area 5.U forms with the vertical S an angle W6.U.

In this case also a free space 11 is provided underneath the rail base 8. The height H of the free space 11 corresponds to the spring excursion E of the rail 1 under normal load N (compare to FIG. 4), so that also the height H of the free space 11 becomes zero under normal load N. Laterally with respect to the rail base 8, on the side facing away from the rail base, the connection piece 9 is provided with recesses 12 (compare to FIG. 3).

Figure 5:
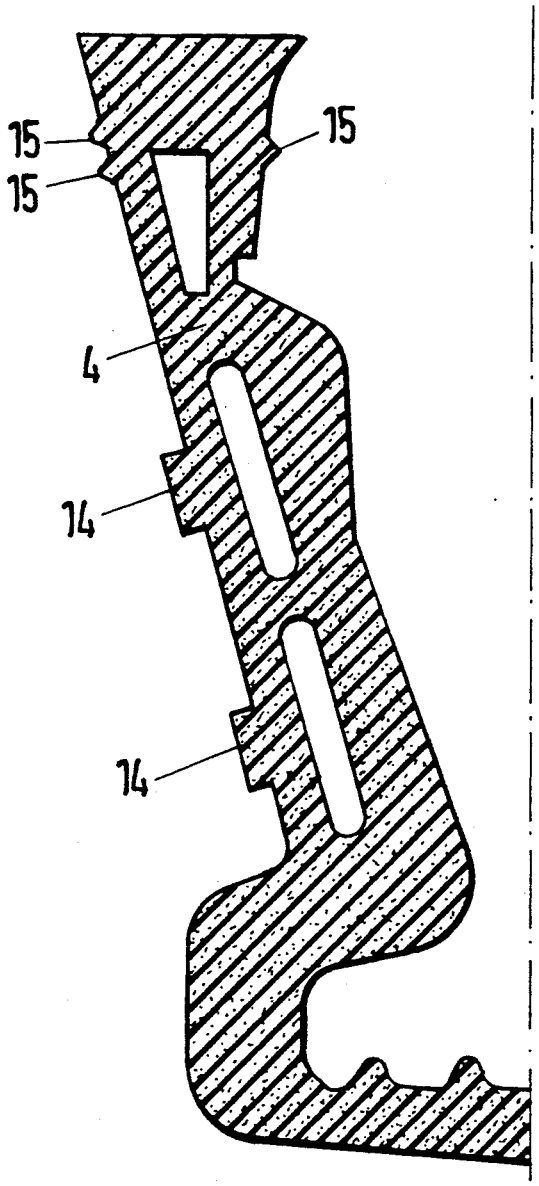
FIG. 5 is a cross sectional view of the left half of an elastic intermediate layer.

FIG. 5 shows the left half of an elastic intermediate layer 4 in a nonstressed state. On its side facing away from the rail 1, the elastic intermediate layer 4 is provided with approximately rectangular projections 14, which serve for prestressing the elastic intermediate layer 4 after its insertion.

Further, the elastic intermediate layer 4 has in its upper area on both sides approximately triangular projections 15, which prevent the penetration of water between the rail and the frame.

Figure 6:
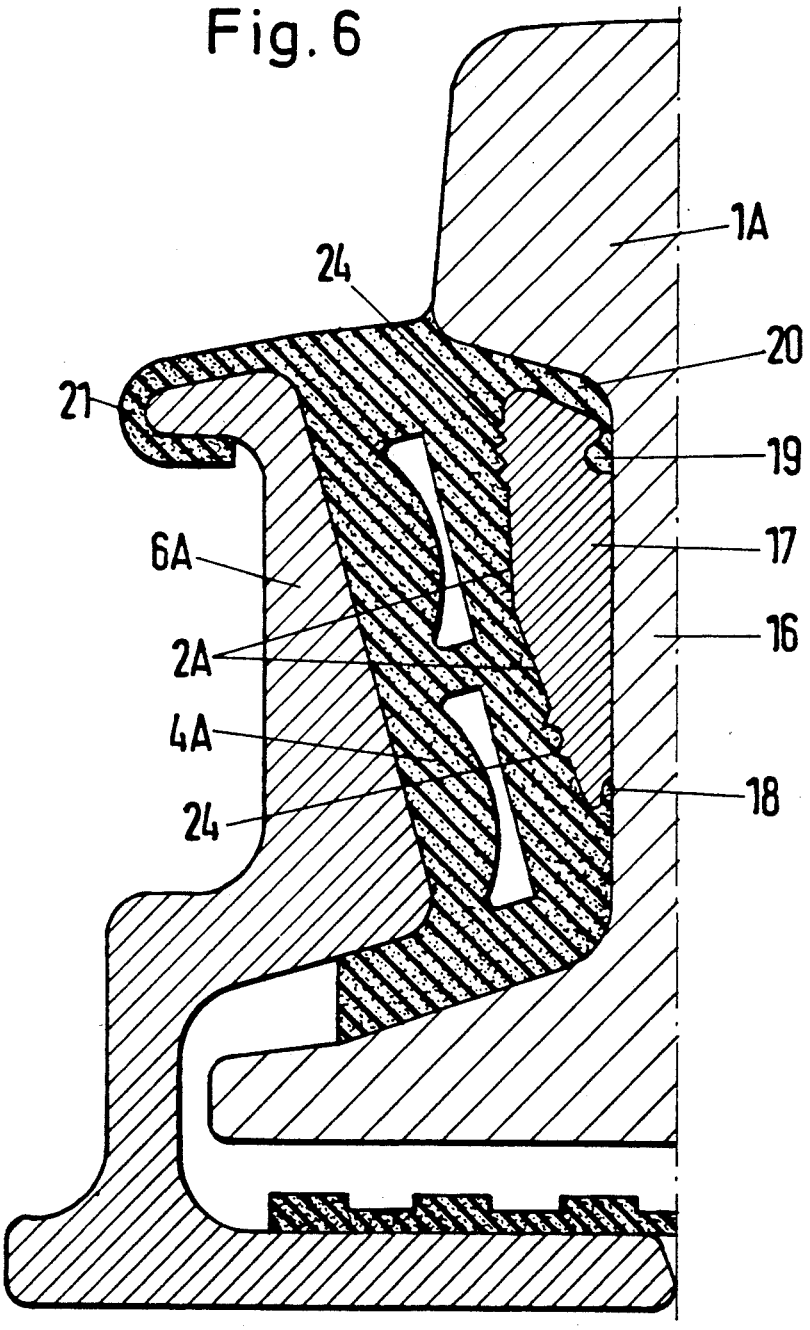
FIG. 6 is a cross sectional view of the right half of a standard rail enclosed in a frame.

In the embodiment shown in FIG. 6, on both sides of the web 16 of a standard rail 1A molded parts 17 are attached. The surface 2A of the molded part 17, which is facing away from the web 16 of rail 1A takes over the function of a lateral surface limiting the web of rail 1A. The molded part 17 is held by a lower nose 18 provided on the elastic intermediate layer 4A and an upper nose 19 located at the end of a projection 20 of the elastic intermediate layer 4A, which reaches over the molded part 17. In turn, the elastic intermediate layer 4A is held by a projection 21 reaching over the upper edge of the frame 6A. On its limiting surface 2A facing away from the web 16 of the rail 1A, the molded part 17 is provided with projections 24 of an approximately triangular shape, which prevent a displacement of the molded parts 17 with respect to the elastic intermediate layer 4A.

Figure 7:
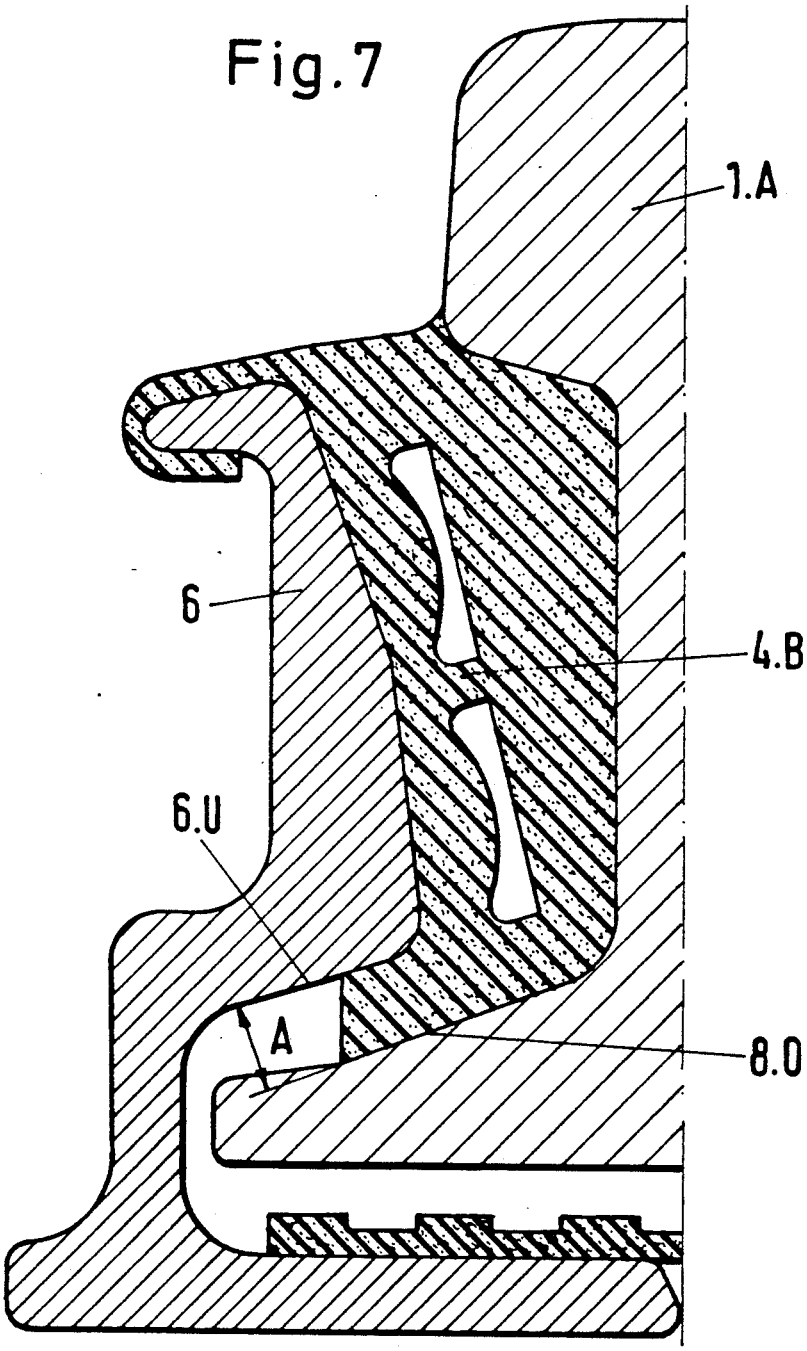
FIG. 7 is a cross sectional view of the right half of another standard rail surrounded by a frame.

The embodiment shown in FIG. 7 also has a standard rail 1A. In this embodiment, the elastic intermediate layer 4B extends until it reaches the web of the standard rail 1A. As can be further seen from this embodiment example, a free space A is provided between the upper surface 8.0 limiting the rail base and the surface 6.U defining the frame 6, the latter surface facing away from the rail base and running somewhat parallel thereto.

I claim:

1. A rail assembly for a rail-vehicle track, comprising:

a rail having:

a rail head, a base, and a shank connecting said head with said base and having a pair of outwardly facing downwardly and inwardly tapering flank shank surfaces;

a frame flanking said rail and having a pair of downwardly tapering members forming a pair of inwardly facing flank frame surfaces spaced from and juxtaposed with the outwardly facing flank shank surfaces of said rail, said frame forming a base spaced below said base of said rail; and elastic intermediate layers disposed between the juxtaposed surfaces of said rail and said frame and prestressed between them with a spring constant from 2 KN/mm to 8 KN/mm per meter of rail length, the flank shank surfaces having:

upper downwardly and inwardly tapering rectilinear portions, and lower downwardly and inwardly tapering rectilinear portions, said lower and upper rectilinear downwardly tapering portions angularly adjoining each other and forming different angles with a vertical, at upper ends of said upper rectilinear portions, upwardly and outwardly turned head surfaces being connected to said upper rectilinear portions, delimiting said head and defining steps between said head and said shank, the frame surfaces being rectilinear and of a single angle with a vertical over a height thereof juxtaposed with the shank surfaces.

2. The rail assembly defined in claim 1 wherein said spring constant is substantially 3.5 KN/mm per meter of rail length.

3. The rail assembly defined in claim 1 wherein said upper portions of said shank surfaces form angles with the vertical between 5° to 10°, said lower portions of said shank surfaces form angles with the vertical between 15° and 30° and said flank frame surfaces form angles with the vertical between 5° and 30°.

4. The rail assembly defined in claim 1 wherein each of said elastic intermediate layers is formed with a plurality of internal chambers.

5. The rail assembly defined in claim 4 wherein said chambers are dimensioned so that said rail has a spring excursion between 1 millimeter and 15 millimeters wherein said rail receives a normal load from a vehicle thereon.

6. The rail assembly defined in claim 5 wherein said chambers are dimensioned such that such excursion is substantially 6 millimeters when said rail receiver said normal lead.

7. The rail assembly defined in claim 6 wherein said chambers are substantially of the cross sectional shape of rectangles elongated along said flank shank surfaces of said rail and of a width decreasing to zero when the rail is under said normal load.

8. The rail assembly defined in claim 4 wherein two of said chambers is provided in each of said elastic intermediate layers.

9. The rail assembly defined in claim 1 wherein said elastic intermediate layers are mutually connected by a connection piece extending below said base of said rail and having a resiliency corresponding to the resiliency of said elastic intermediate layers, a clearance being provided between said connection piece and said base of said rail of a height corresponding to a spring excursion of said rail when it reaches a normal load.

10. The rail assembly defined in claim 9 wherein said connection piece is formed with spaced apart projections extending over said height.

11. The rail assembly defined in claim 1 wherein said elastic intermediate layers are formed at upper regions thereof with projections of an approximately triangular cross sectional shape filling gaps between said head and said tapering members of said frame.

* * * * *